US007553244B2

(12) United States Patent
York

(10) Patent No.: US 7,553,244 B2
(45) Date of Patent: Jun. 30, 2009

(54) BALL RECEIVING AND LAUNCHING MACHINE

(76) Inventor: Michael Timothy York, 10113 S. 250 W., Pendleton, IN (US) 46064

( * ) Notice: Subject to any disclaimer, the term of this patent is extended or adjusted under 35 U.S.C. 154(b) by 38 days.

(21) Appl. No.: 11/633,747

(22) Filed: Dec. 5, 2006

(65) Prior Publication Data

US 2007/0149326 A1 Jun. 28, 2007

Related U.S. Application Data

(60) Provisional application No. 60/754,111, filed on Dec. 27, 2005.

(51) Int. Cl.
*A69B 69/00* (2006.01)
*F41B 4/00* (2006.01)

(52) U.S. Cl. ..... 473/438; 473/431; 124/78

(58) Field of Classification Search ..... 473/438, 473/422, 431, 451; 124/6, 78
See application file for complete search history.

(56) References Cited

U.S. PATENT DOCUMENTS 3,977,386 A * 8/1976 Meyer ..... 124/7
4,026,261 A * 5/1977 Paulson et al. ..... 124/78
4,511,141 A * 4/1985 Dumas ..... 473/419
4,714,248 A * 12/1987 Koss ..... 473/436
4,772,017 A 9/1988 Eriksen
5,417,196 A 5/1995 Morrison et al.
5,487,540 A * 1/1996 Bixler et al. ..... 473/436
5,776,018 A * 7/1998 Simpson et al. ..... 473/433
6,241,628 B1 * 6/2001 Jenkins et al. ..... 473/436
6,575,852 B2 * 6/2003 Orner ..... 473/438
6,616,555 B2 * 9/2003 Bewley ..... 473/451
6,877,501 B2 * 4/2005 Wojtkiewicz et al. ..... 124/78
7,125,349 B2 * 10/2006 Tucker ..... 473/438
7,137,910 B2 * 11/2006 Ktson et al. ..... 473/431

OTHER PUBLICATIONS

Ryan Canfield, Craig Cotterman & Greg Lopshire, www.tristate.edu/ME.AE.Dept/ME/seniordesign.htm, date unknown.

* cited by examiner

*Primary Examiner*—Mitra Aryanpour
(74) *Attorney, Agent, or Firm*—Michael York

(57) ABSTRACT

Disclosed herein is a football receiving and launching machine that receives thrown footballs into a ball collector, orients the football and transfers the football into a ball accelerator that launches the football into the air automatically, enabling the user to practice catching and throwing footballs without the assistance of another player.

13 Claims, 9 Drawing Sheets

BALL RECEIVING AND LAUNCHING MACHINE

CROSS-REFERENCE TO RELATED APPLICATIONS

This application claims the priority of U.S. Provisional Patent Application 60/754,111, filed Dec. 27, 2005, and is herein incorporated by reference in its entirety.

TECHNICAL FIELD

The application relates generally to machine that is designed to receive footballs that are thrown into it, orient them and to launch them back to the user automatically.

BACKGROUND OF THE INVENTION

Football throwing and catching is an extremely popular sport that is enjoyed by all age groups. Enthusiasts enjoy practicing throwing and catching footballs in yards, gyms and parks to improve their skill. One of the difficulties associated with practicing throwing and catching skills is that it requires at least two players. It is not possible for an individual to practice throwing and catching the football without the assistance of another player. There exist machines that will launch footballs that have previously been loaded into them, but they do not receive thrown footballs and therefore cannot be used for individuals wishing to throw and catch by themselves.

BRIEF SUMMARY OF THE INVENTION

Disclosed herein is a football receiving and launching machine that enables a user to throw oval shaped footballs into the machine and receive oval shaped footballs that are automatically thrown from the machine at a variety of angles and elevations. In addition, the machine may also include a rotatable base that rotates the launcher at a desired rate to allow the user to receive thrown footballs while the user is running.

In the first embodiment, the launcher includes a collector including a compliant material for receiving thrown footballs. The collector dissipates the inertia of the thrown football and guides that football down into a football orientor which orients the football using a series of orientation features and a translator for transporting the football. The translator, advances the football toward spinning wheels that are preferably tilted in relation to each other. The wheels are spaced apart from each other slightly less than the diameter of one football and spin in such a way as to urge the football between the wheels when one end of the football comes in contact with the wheels. Therefore, the wheels combine to form a ball accelerator. One or more electric motors are mounted to a base that supports the motor, ball collector, football orientor and the ball accelerator. The football accelerates between the wheels and is thrown through the air toward the user. This machine can also be used with round balls that do not need specific orientations.

Further disclosed herein is a method for receiving and throwing a football. A football is thrown into a collector and the collector guides the football to a football orientor that orients the football. The football is advanced into a ball accelerator which launches the football into the air.

In an alternative embodiment of a launcher, the football orientor and conveyor portion of the original embodiment have been replaced by a ball guide that allows footballs to roll down the guide into the rotating wheels or cogs.

BRIEF DESCRIPTION OF THE DRAWINGS

Referring to the exemplary drawings wherein like elements are numbered alike in the accompanying Figures.

DETAILED DESCRIPTION OF THE INVENTION

Figure 1:
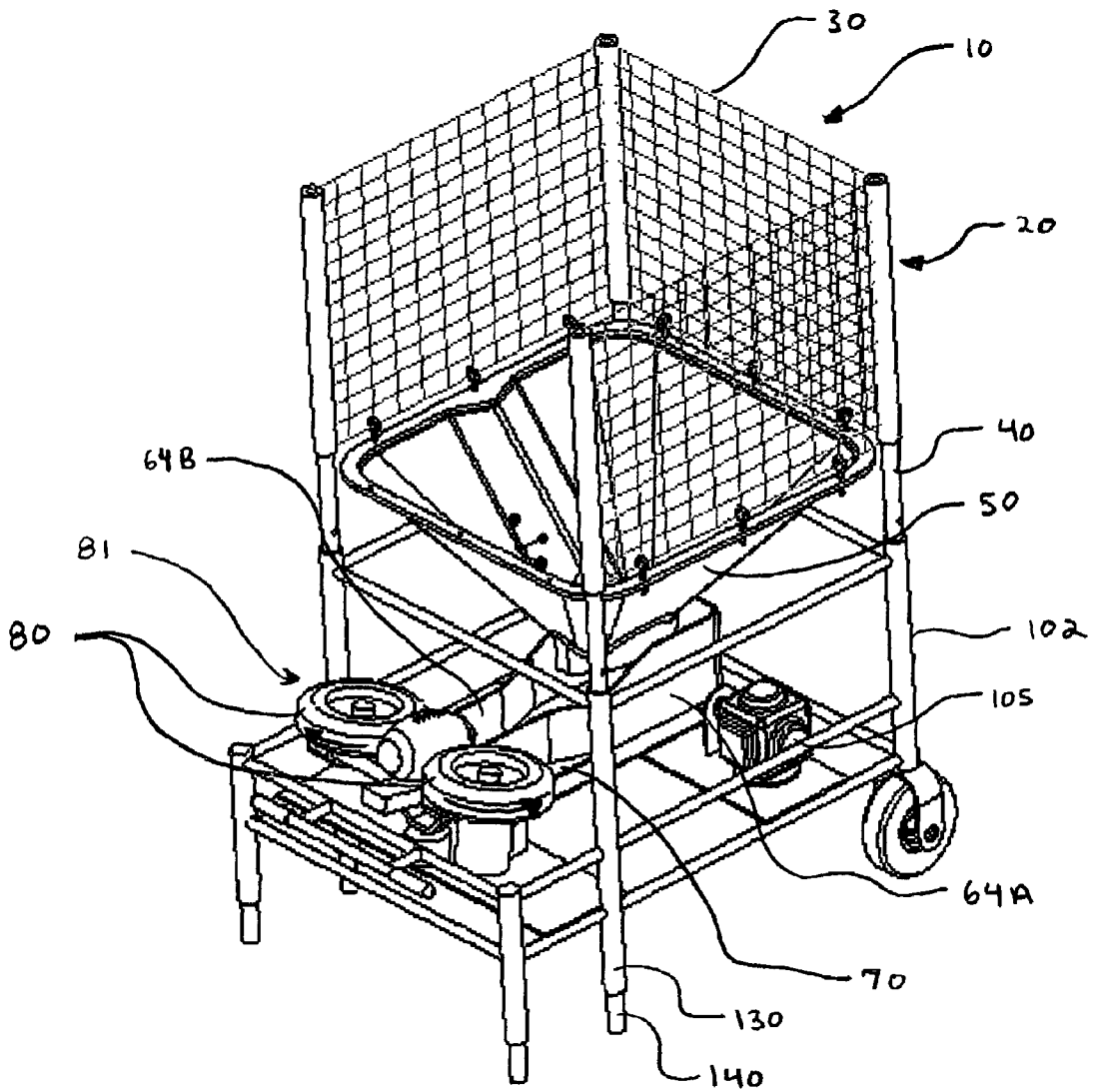
FIG. 1 is a perspective view of a ball receiving and launching machine.

FIGS. 1-5 illustrate a first exemplary embodiment of the present invention, a launcher 10 for launching and receiving oval shaped footballs having two ends. As can be seen in FIG. 1, launcher 10 contains a collector 20 for receiving thrown footballs, a ball orientor 50 for guiding and orienting footballs that fall from the collector, a translator in the form of a conveyor belt 70 that advances the football forward and spinning wheels 80 that combine to form a ball accelerator 81 to accelerate and launch footballs into the air. The collector, orientor, conveyor and wheels are supported by a base 102 that includes leg blocks 130 that have adjustable legs 140 allowing each corner of the base to be adjusted to the desired height above the floor. The base, leg blocks and legs are constructed from relatively rigid material as for example plastic or metal. It should be understood that base 102 could be replaced by multiple bases or a support frame that would perform the same function as base 102.

Collector 20, shown in FIG. 1, includes a net 30 that is supported by a net frame 40 along the outer boundary of the net. The net can be made from any type of netting material, as for example polyamide strands. The net is used to absorb the impact of a thrown football minimizing rebounding of the football and allowing the football to fall into ball orientor 50. Net frame 40 supports the net and is preferably made out of rigid material, as for example metal or plastic tubing, and can be made up of an assembly of several parts, such as short sections of tubes that fit together to makeup the net frame. Net frame 40 is secured to base 102. It is to be understood that other materials could be used instead of a net and frame assembly that would perform substantially the same function of absorbing a thrown ball's energy and guiding the football into ball orientor 50.

Figure 6:
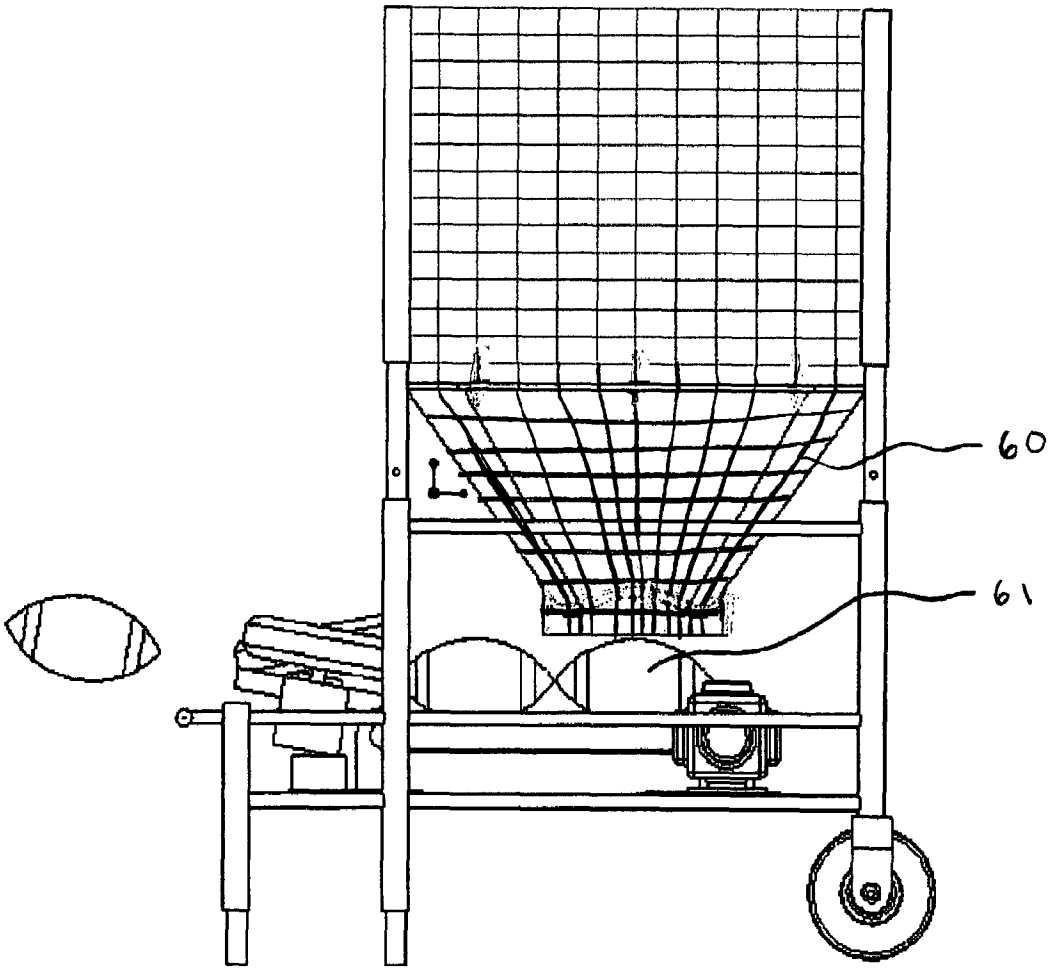
FIG. 6 is a side view of an alternative embodiment of the ball receiving and launching machine.

Launcher 10 has ball orientor 50 that receives footballs from collector 20 and guides the falling football down to conveyor belt 70. The orientor is a funnel-type structure having sloped sides as show in FIGS. 1, 2 and 3 that are attached to base 102. Ball orientor 50 is shown in the shape of a rectangular funnel, but may have many different shapes that would work equally as well. Alternatively, ball orientor 50 could be replaced with guide net 60, as shown in FIG. 6. When the football is dropped from the collector into the ball orientor, guide net 60 guides the falling football into a narrow resting position on the conveyor belt or other type of translator, shown as first position 61. Guide net 60 or the funnel-type ball orientor 50 could also guide the ball directly into ball accelerator 81.

Figure 5:
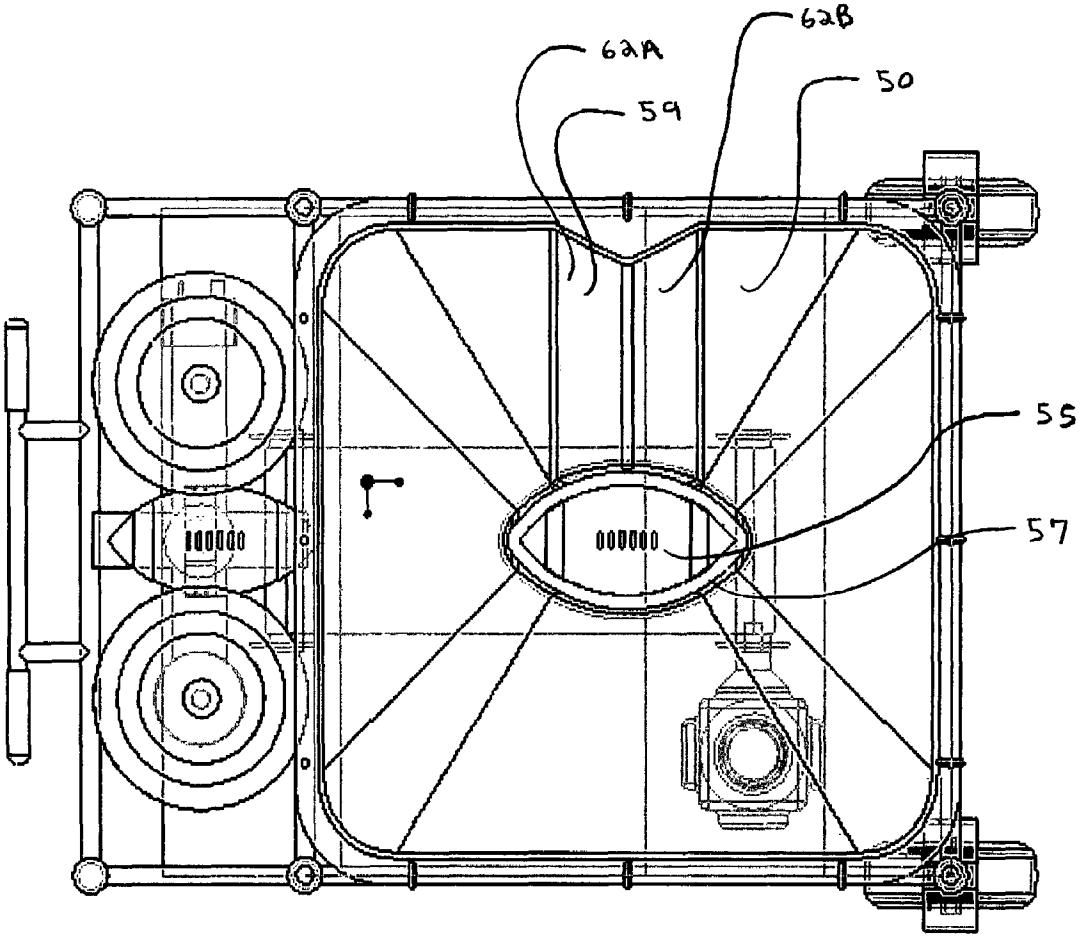
FIG. 5 is a top view of the ball receiving and launching machine.

In addition to ball orientor 50, the football can be further oriented while it is being transported on the translator as can be seen in FIG. 1. This can be accomplished by right and left orientation features 64A and 64B respectively. The right and left orientation features are supported by base 102 and are designed to orient the advancing football on the conveyor belt or other type of translator into a general orientation so that the football is end to end aligned with the length of the conveyor belt and is pointing to a position approximately centered between spinning wheels 80 as shown in FIG. 5.

The right and left orientation features are designed to rotate or flip the advancing football on the conveyor belt in an end to end position if the ball does not already land this way on the belt from ball orientor 50. This is accomplished by the stationary orientation features coming in contact with the miss-oriented football while it is advancing forward on the convey belt. The amount of engagement between a miss-aligned football and the orientation features is increased as the football advances on the conveyor belt toward the spinning wheels. The increased contact causes the football to rotate or flip into and end to end position aligning with the conveyor belt as it is advanced toward wheels 80. Orientation features 64A and 64B may also be integrated as part of ball orientor 50 to reduce the number of components required for the launcher.

Figure 7:
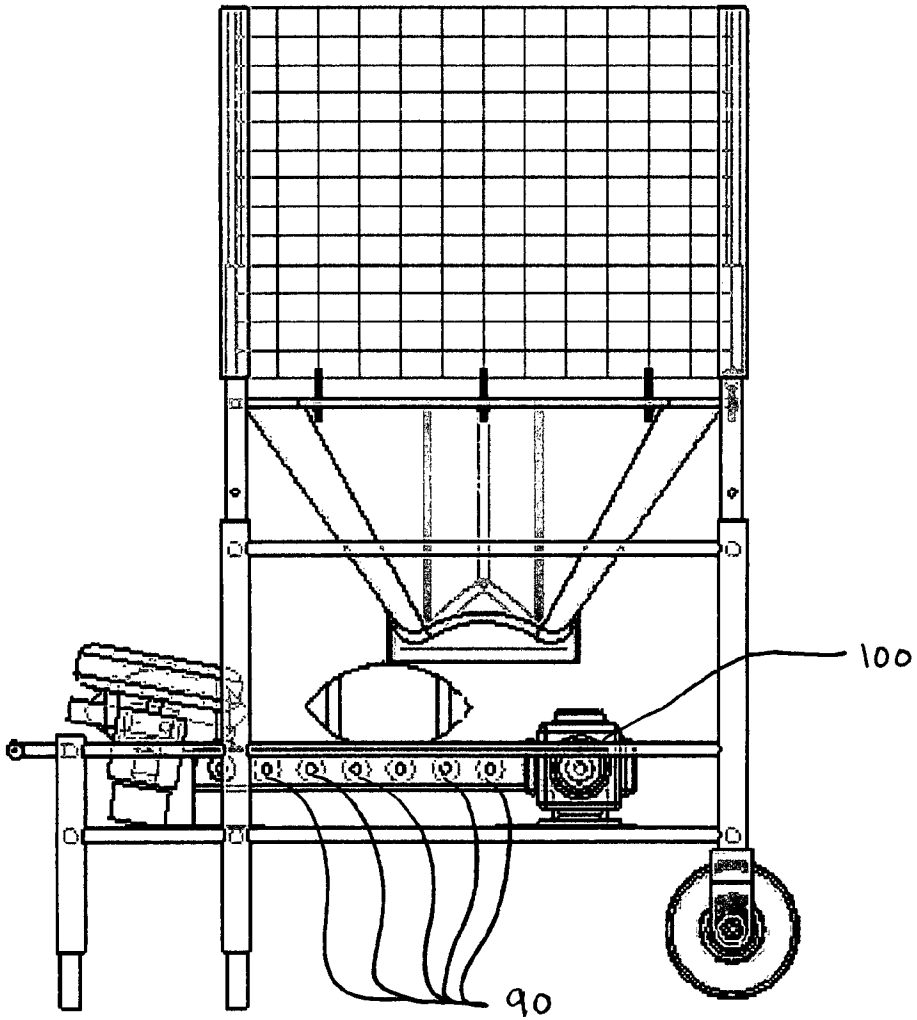
FIG. 7 is a side view of the ball receiving and launching machine having powered rollers to translate the ball.
Figure 8:
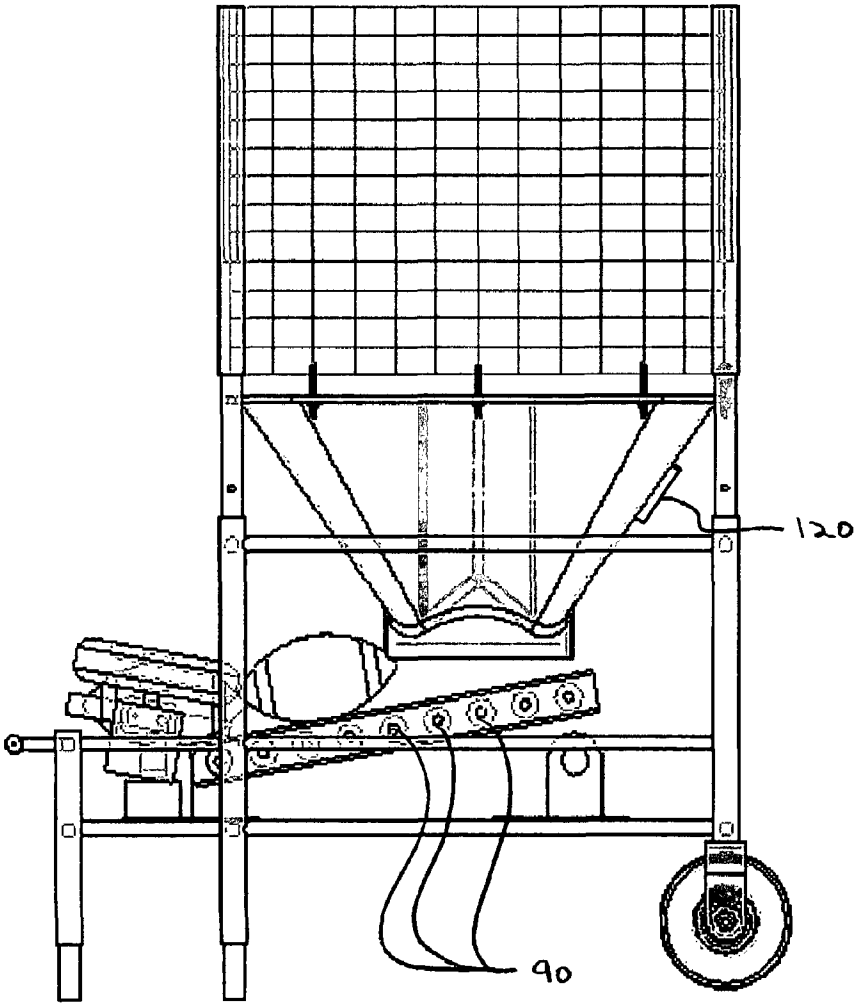
FIG. 8 is a side view of the ball receiving and launching machine having rollers to translate the ball.

It should be understood that other transferring means may be used instead of conveyor belt 70 that would serve the same purpose of advancing the football toward wheels 80. For example, the conveyor belt could be replaced by a plurality of small rotating roller wheels 90 as shown in FIG. 7. Roller wheels 90 can be driven by a roller motor 100 or may inclined on an angle, shown in FIG. 8, that allow the football to roll over the roller wheels. Also, conveyor belt 70 could be replaced with a plurality of smaller belts that combine to translate the football toward the ball accelerator. In addition ball orientor 50 and the ball translating means could be combined into one unit that performs both functions. In addition, the orientation features could also be secured to launcher 10 in a different manner than previously described.

Figure 2:
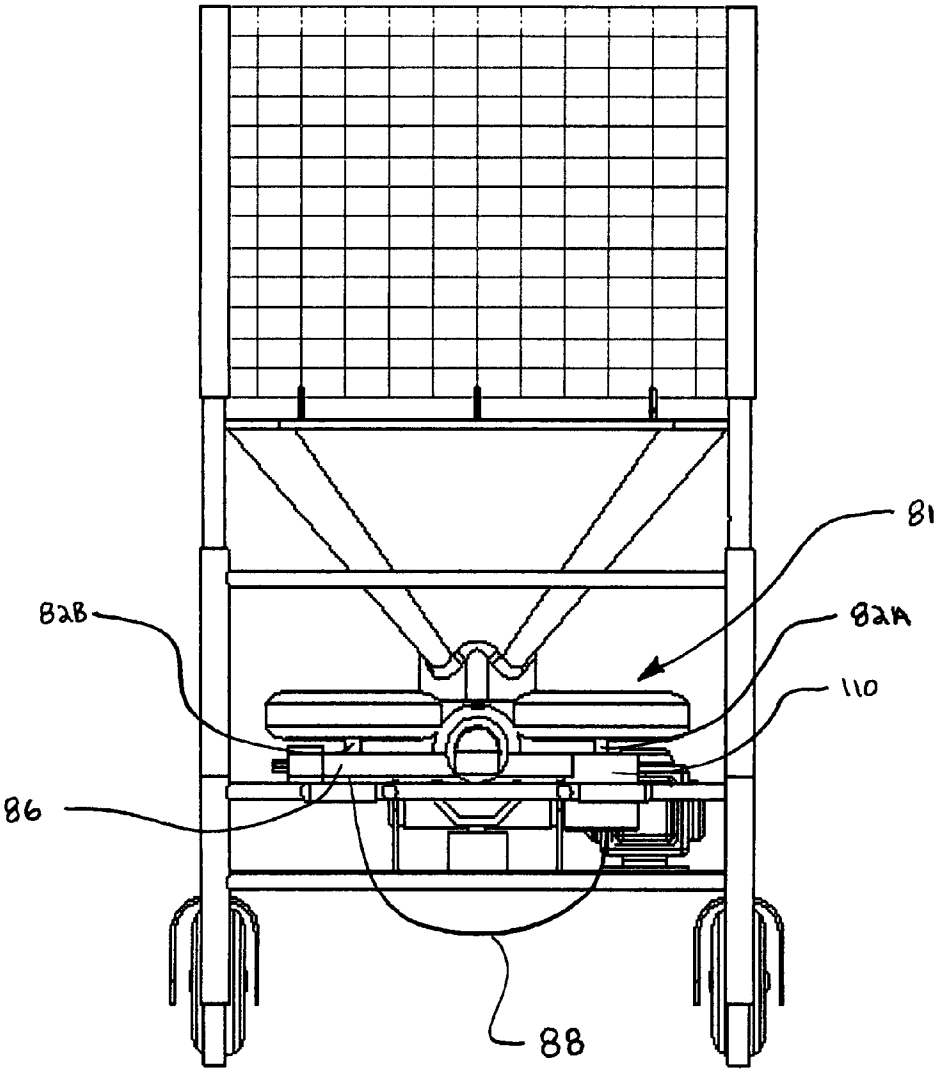
FIG. 2 is a front view of the ball receiving and launching machine.

Wheels 80 spin in the direction shown in FIG. 1 and are supported by shafts 82A and 82B, shown in FIG. 2. Shaft 82A is installed into a wheel motor 110 and shaft 82B is install into a support block 86 mounted onto base 102. The wheels are fixed to the shafts so that the shafts and wheels rotate together. Bearings (not shown) are contained within support block 86 to allow for rotation of shaft 82B mounted within the support block. Shaft 82B is driven by a torque transfer cable 88 that extends from wheel motor 110 over to shaft 82B. This type of ball accelerator construction is common in the art and will not be discussed in detail. The wheel motor may be electric and is mounted onto base 102 and rotates shafts 82A and 82B. Wheels 80, shaft 82A, shaft 82B, support block 86 and wheel motor 110 combine to form ball accelerator 81. Conveyor belt 70 is driven by conveyor motor 105. Alternatively, wheel motor 110 can be used to drive wheels 80 and conveyor belt 70 by the use of pulleys and belts or other energy transferring means. Since driving these types of mechanisms is common practice among those skilled in the art, they will not be described in detail. It should be well understood that there exists many different methods that are commonly used to drive the conveyor and the accelerator, therefore, the scope of this invention is not meant to be limited to the described means.

Ball orientor 50 is shaped to provide initial orientation of a football 55 as is shown in FIG. 5. The ball orientor includes tapered side walls 51, best seen in FIG. 3, that urge the football to a specific end point near the bottom of the ball orientor. In addition, an opening 57 is provided at the end of ball orientor 50. The opening is shaped to only allow certain football orientations to slide through it as shown in FIG. 5. In this way, the orientation of the football that is transferred to conveyor belt 70 or other type of ball translator is limited to only the football orientations that will fit through opening 57. Anti-jam feature 59 is incorporated within the ball orientor to help prevent miss-aligned footballs from jamming within the ball orientor. The anti-jam feature includes raised surfaces 62A and 62B that urge a football that has one end touching either of the surfaces to roll off of that surface. In this way, the football is partially aligned to the desired orientation. Other anti-jam type features may also be incorporated within ball orientor 50 to help prevent football jams within the orientor. One example is a vibrator 120, shown in FIG. 8. The vibrator is mounted onto the side of ball orientor 50 to vibrate the ball orientor and prevent the football from jamming. Vibrators of this type are common, therefore, the inner workings of this type of device will not be described further.

Figure 3:
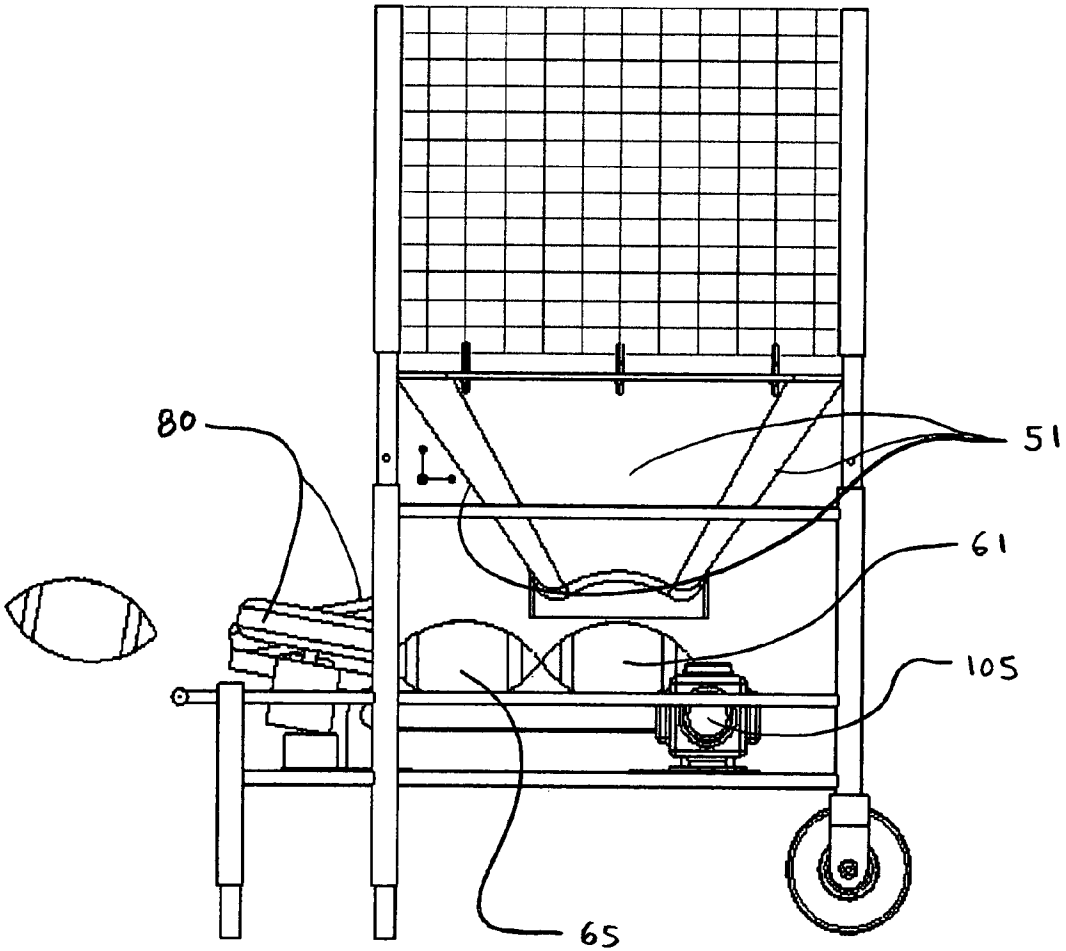
FIG. 3 is a side view of the ball receiving and launching machine.
Figure 4:
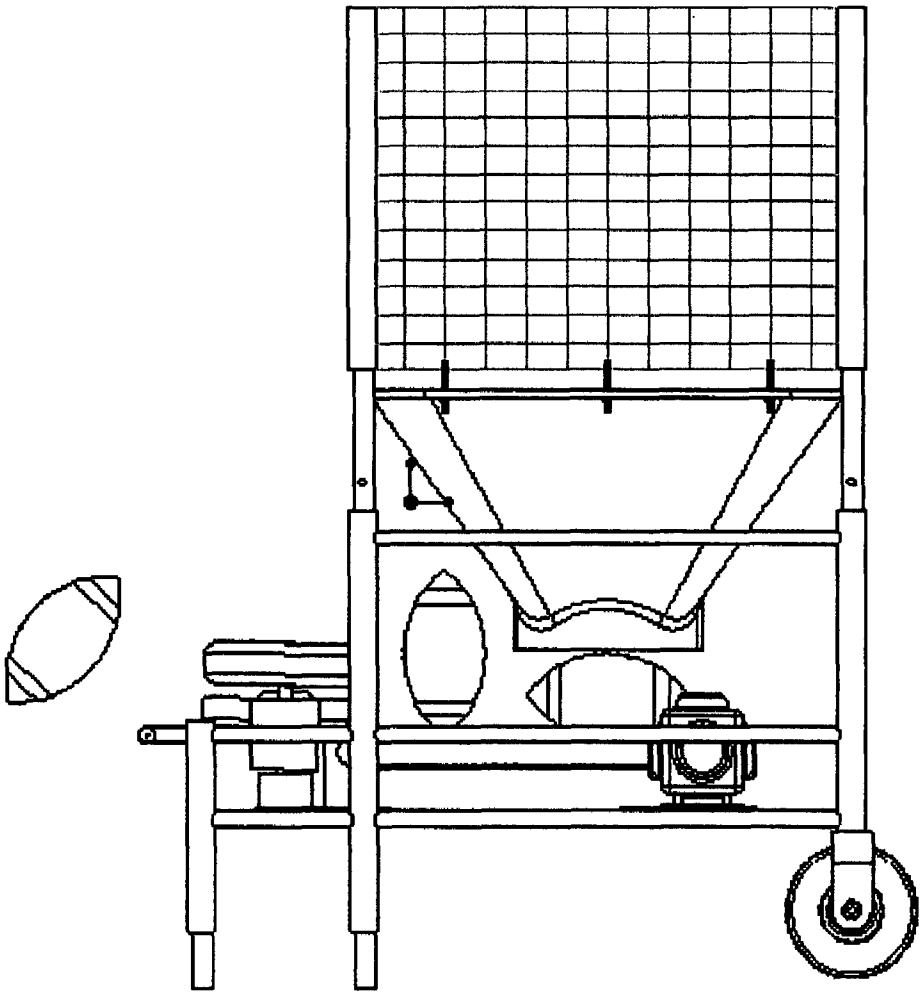
FIG. 4 is a side view of the ball receiving and launching machine adjusted to present the football to the ball accelerator in an upright orientation.

FIG. 3 illustrates how the football may come to rest in first position 61 on the conveyor belt and is advanced by the moving conveyor belt toward the rotating wheels while at the same time is being oriented into second position 65 by orientation features 64A and 64B. Conveyor belt 70 continues to advance the football toward wheels 80 until the end of the oriented football come in contact with the wheels. Wheels 80 are spaced apart a distance less than the diameter of the football to enable the wheels to squeeze the football between them while the football is accelerated and rotated by the tilted wheels 80 until it loses contact with the wheels and is launched into the air as shown in FIG. 3. The player (not shown) positions himself or herself in an area away from launcher 10 in the direction that the football is launched and catches the football. After catching the football, the player may elect to throw the football back into collector 20 of the launcher to have it launched back to him again. Wheels 80 are preferably made from rubber or plastic material that has a relatively high coefficient of friction between the surfaces of the wheels and the football. Metal wheels could also be used, but may lead to excessive football wear. Alternatively, wheels 80 could be notched or cogged instead of being round. In this configuration, the cogged wheels need not rotate continuously, but instead, can be rotated only when the football is in the desired position, shown in the figure. Wheels 80 could also be replaced with paddles or other types of mechanisms that serve to accelerate and launch the football or other types of balls.

Launcher 10 has several adjustable features that modify the trajectory of the thrown football. Wheels 80 may be tilted horizontally relative to each other, as shown in FIG. 3, to cause the football to rotate about its axis running through the ends of the football while the football is accelerated between the wheels. This action causes the football to spiral through the air after being launched from the wheels. In addition, the distance between the wheels may be varied to enable different size footballs to be thrown and to vary the amount of contact between the football and the wheels. If the user desires to have the football launched in an end over end fashion, orientation features 64A and 64B may be adjusted to present the football to wheels 80 in an upright position, shown in FIG. 4. This is to simulate a kickoff type flight pattern of the football. The rotation speed of wheel motor 110 may also be adjusted to determine how fast and far the football is launched. Legs 140 may be threaded in and out of leg blocks 130 to adjust the elevation of the front and back of the base 102 in order to set the angle and height in which the launcher throws the football. Adjustments can also be made to allow launcher 10 to receive and launch round balls in addition to footballs. Orientation features 64A and 64B can be adjusted to only narrow the path for a round ball traversing on the conveyor to deliver it in between the wheels, since there is no specific orientation of a round ball.

Figure 9:
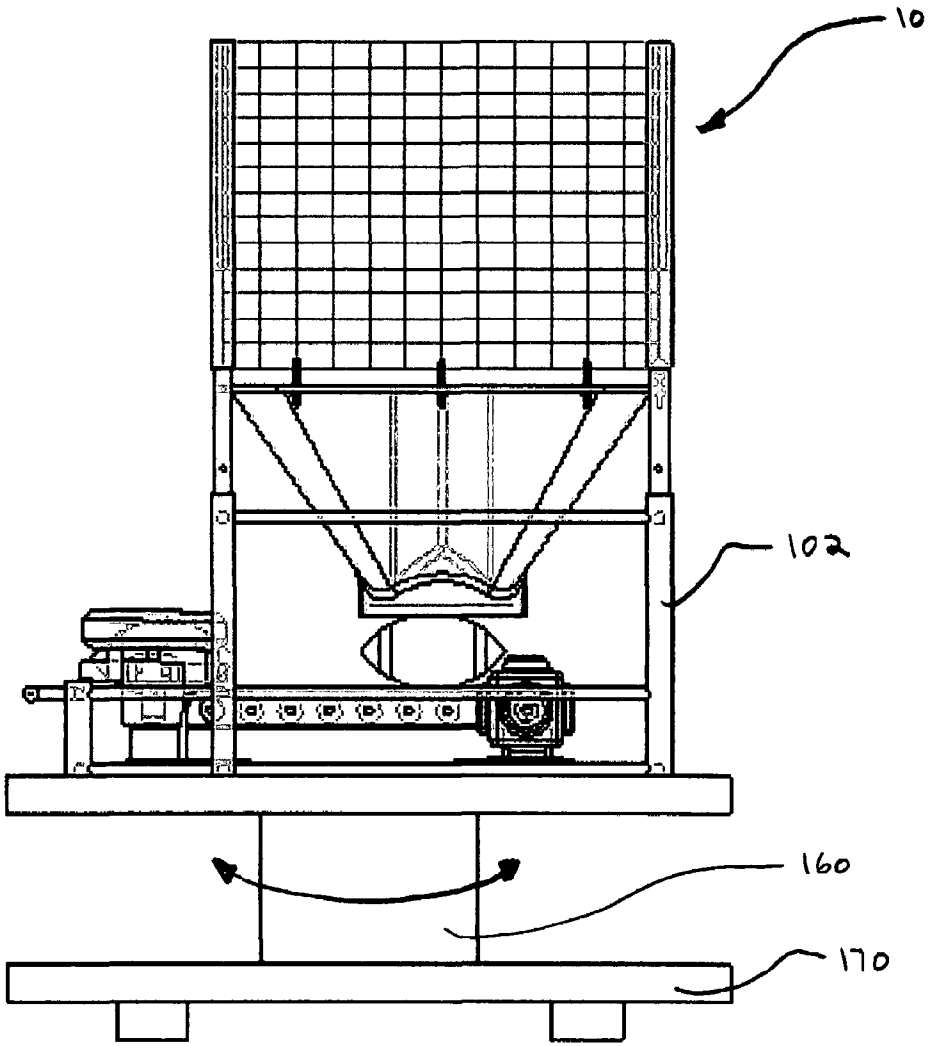
FIG. 9 is a side view of the ball receiving and launching machine setup for use with round balls.

As shown in FIG. 9, an alternative embodiment of the ball launcher having a rotating base 160 has been added that rotates base 102 relative to a lower base 170. This allows ball launcher 10 to rotate while footballs are launched into the air, throwing footballs to varying positions, enabling the user to run to the footballs to catch them. The rotating base 160 preferably rotates through a predetermined angle range, launching footballs after they are thrown and oriented in the machine until the maximum rotation angle is reached, then the rotating base begins to rotate the opposite direction until the opposite maximum rotation angle is reached and the cycle is repeated. Rotating base mechanisms are common in the art, therefore, the inner workings of the rotating base will not further be described. As an alternative, a rotating mechanism could be added to just rotate the ball accelerator to perform the same function previously described without having to rotate the entire base.

A gating device (not shown) can be added to the orientor to enable the user to release footballs one at a time via a transmitter if more launching control is desired.

While the invention has been described with reference to a preferred embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A machine for receiving and launching oval shaped footballs having two ends, said machine comprising:

a collector for receiving said footballs thrown directly into said collector by a user, wherein said collector can receive oval shaped footballs thrown in any orientation;

a funnel-type football orientor having sloped sides for orienting and guiding said oval shaped footballs having two ends, wherein said orientor includes structural elements that contact randomly oriented miss-aligned said oval shaped footballs that fall from said collector and at least partially orient them to a predetermined desired orientation;

said collector being made from a compliant material supported by a rigid frame and having sufficient width and height and an opening to enable said collector to absorb the impact of said football thrown from distance into said collector, minimizing rebounding of said football and allowing said football to rail into said football orientor;

a football accelerator for launching said footballs into the air;

a motor for operating said football accelerator;

wherein said football orientor receives said footballs from said collector and is in operable communication with said football accelerator.

2. The football receiving and launching machine of claim 1 wherein said football accelerator includes at least one wheel that is spun to accelerate said football.

3. The football receiving and launching machine: of claim 1 further comprising a rotating mechanism that rotates said football accelerator through a predetermined angle range.

4. The football receiving and launching machine of claim 1 wherein said football accelerator includes at least two wheels that are horizontally tided relative to each other to produce a spin on the launched football.

5. The football receiving and launching machine of claim 1 wherein said football orientor further comprises at least one anti-jam feature to prevent the football from jamming.

6. The football receiving and launching machine; of claim 5 wherein said anti-jam feature is a vibrator.

7. A machine for receiving and launching oval shaped footballs having two ends, said machine comprising:

a collector for receiving said footballs thrown directly into said collector by a user, wherein said collector can receive said oval shaped footballs thrown in any orientation;

a funnel-type football orientor having sloped sides for orienting and guiding said oval shaped footballs, wherein said football orientor further comprises a football translator for advancing said footballs, wherein said football translator includes structural elements that contact randomly oriented miss-aligned said oval shaped footballs that fall from said collector and at least partially orient them to a predetermined desired orientation;

a football accelerator for launching said footballs into the air;

said football translator transports said footballs from said collector to said football accelerator, maintaining a predetermined orientation of said oval shaped footballs, wherein said football translator being in operable communication with said collector and said football accelerator;

a motor for operating said football accelerator; and said collector being made from a compliant material supported by a rigid frame and having sufficient width and height and an opening to enable said collector to absorb the impact of said football thrown from a distance into said collector, minimizing rebounding of said football and allowing said football to fall into said football orientor;

wherein said football orientor positions said oval shaped footballs being transported on said football translator.

8. The football receiving and launching machine of claim 7 wherein said football orientor includes orientation features that contact miss-aligned footballs as they advance toward said football accelerator and orient said footballs into specific orientations.

9. The football receiving and launching machine of claim 7 wherein said football accelerator includes at least one wheel that is spun to accelerate said football.

10. The football receiving and launching machine of claim 7 further comprising a rotating mechanism that rotates said football accelerator through a predetermined angle range.

11. The football receiving and launching machine of claim 7 wherein said football accelerator. includes at least two wheels that are horizontally titled relative to each other to produce a spin on the launched football.

12. A machine for receiving and launching oval shaped footballs having two ends, said machine comprising:

a collector for receiving said footballs thrown directly into said collector by a User, wherein said collector can receive footballs thrown in any orientation;

a funnel-type football orientor having sloped sides for orienting and guiding said oval shaped footballs having two ends, wherein said footballs thrown into said collector travel past said football orientor, said orientor includes mechanical elements that contact mis-aligned said oval shaped footballs to at least partially orient them to a predetermined desired orientation;

said collector being made from a compliant material supported by a rigid frame and having sufficient width and height and an opening to enable said collector to absorb the impact of said football thrown from a distance into said collector, minimizing rebounding of said football and allowing said football to fall into said football orientor;

a football accelerator for launching said footballs into the air, said football accelerator includes at least one wheel that comes in contact with said footballs and is spun to accelerate said footballs, wherein said wheel is driven by a motor; and a motor for operating said football accelerator, wherein said football orientor receives footballs from said collector and is in operable communication with said ball accelerator.

13. The football receiving and launching machine of claim 12 wherein said football orientor further comprises a football translator for advancing said footballs from said football orientor to said football accelerator.

* * * * *

UNITED STATES PATENT AND TRADEMARK OFFICE

CERTIFICATE OF CORRECTION

PATENT NO. : 7,553,244 B2
APPLICATION NO. : 11/633747
DATED : June 30, 2009
INVENTOR(S) : Michael Timothy York It is certified that error appears in the above-identified patent and that said Letters Patent is hereby corrected as shown below:

Claims

"Col. 5, line 60, claim 1, change 'rail' to -- fall --."

"Col. 6, line 9, claim 4, change 'tided' to -- tilted --; line 61, claim 7, change 'titled' to -- tilted --."

Signed and Sealed this
Thirteenth Day of October, 2015

Michelle K. Lee

Michelle K. Lee
*Director of the United States Patent and Trademark Office*